US008376138B2

(12) United States Patent
Campbell

(10) Patent No.: US 8,376,138 B2
(45) Date of Patent: Feb. 19, 2013

(54) CONTAINER WITH COMBINED LOCKING AND INDICATING FASTENER

(76) Inventor: Bruce Campbell, Ottawa (CA)

( * ) Notice: Subject to any disclaimer, the term of this patent is extended or adjusted under 35 U.S.C. 154(b) by 366 days.

(21) Appl. No.: 12/528,473

(22) PCT Filed: Oct. 22, 2008

(86) PCT No.: PCT/CA2008/001842

§ 371 (c)(1),
(2), (4) Date: Aug. 25, 2009

(87) PCT Pub. No.: WO2010/045703

PCT Pub. Date: Apr. 29, 2010

(65) Prior Publication Data

US 2010/0326864 A1 Dec. 30, 2010

(51) Int. Cl.
*B65D 90/00* (2006.01)

(52) U.S. Cl. ..... 206/459.5; 206/1.5

(58) Field of Classification Search ..... 116/306, 116/307, 200, 1; 70/64, 68, 432; 229/76, 229/77, 78.1, 78.2; 383/97, 61.3, 61.5, 79, 383/92; 206/459.1, 1.5, 459.5
See application file for complete search history.

(56) References Cited

U.S. PATENT DOCUMENTS 428,387 A * 5/1890 Enholm ..... 383/86.2
2,166,860 A * 7/1939 Davis ..... 70/65
2,684,097 A * 7/1954 Treul ..... 383/38
3,637,000 A * 1/1972 Walger et al. ..... 383/61.3
3,818,963 A * 6/1974 Whitman ..... 383/40
3,971,458 A 7/1976 Koenig
4,419,016 A 12/1983 Zoltan
4,494,592 A 1/1985 Bonner
4,514,915 A 5/1985 Galetta
4,783,978 A * 11/1988 Vallerga ..... 70/65
4,792,026 A * 12/1988 Dimmick et al. ..... 190/101
4,889,230 A * 12/1989 Zachry ..... 206/362
4,985,879 A * 1/1991 Owens ..... 368/89
5,013,162 A 5/1991 Williams et al.
5,065,602 A 11/1991 Williams et al.
5,600,978 A * 2/1997 Netto ..... 70/64
6,074,094 A * 6/2000 Manolizi et al. ..... 383/5
6,112,383 A 9/2000 Salam
6,467,135 B1 10/2002 Schuster et al.
6,510,593 B1 1/2003 Kim
6,554,136 B2 4/2003 Priebe
6,568,852 B1 * 5/2003 Godshaw et al. ..... 383/2
6,769,545 B1 8/2004 Mallams
6,848,581 B2 2/2005 Cohen
6,877,345 B1 * 4/2005 Misner et al. ..... 70/25
6,976,293 B2 12/2005 Traulle et al.
7,017,513 B2 3/2006 Giewercer
7,111,714 B1 9/2006 Bell, III
7,222,736 B1 5/2007 Seijas
7,269,476 B2 9/2007 Ratnakar

* cited by examiner

*Primary Examiner* — Andrew Perreault

(57) ABSTRACT

A container with a combined locking and indicating fastener is provided. A slide fastener (16), such as a zipper, used to seal the container continues along a strip (14) projecting from the main body (10) of the container. The strip (14) has numerous lock engaging means (30), such as apertures, and indicia (32) associated with each lock engaging means (30). The lock engaging means (30) and the strip (14) are dimensioned so that a lock (34) secured to one of the lock engaging means (30) prevents the slider (17) of the slide fastener (16) from passing the lock (34). In this way, a lock (34) may be used to both securely close the container and also to indicate information about the container by means of the position of the lock (34) relative to the indicia (32).

17 Claims, 8 Drawing Sheets

CONTAINER WITH COMBINED LOCKING AND INDICATING FASTENER

FIELD OF THE INVENTION

This invention relates to slide fasteners, and more particularly to slide fasteners having multiple locking positions.

BACKGROUND OF THE INVENTION

Containers often include indicia relating to the nature or purpose of the contents of the container. For example, routing envelopes include routing information such as the names of people or departments to whom the envelope is to be routed. The routing information is usually marked on the routing envelope with a pen. As another example, medicine trays include a day of the week and sometimes a time of day next to or on the lid of each individual dosage compartment.

However these containers generally do not have a locking mechanism, which can be important in the case of sensitive information being routed or in the case of medicine which is to be stored in a tamper-evident way. Although other containers have locking mechanisms and may even have indicia, such as bank bags, the opportunity for indicia on these containers is generally limited. For example, courier bags are often lockable but the indicia are typically limited to a single pocket into which a printed label is inserted. And even then, the locking mechanism and the indicia are separate from each other, requiring additional manipulation of the container to both lock the container and to set the correct indicia.

A container design which allowed combined locking and indicating would simplify handling of the container while providing both security and information related to the contents of the container in a simple manner.

SUMMARY OF THE INVENTION

According to one aspect, the invention provides a container. The container has a main body having an opening through which the interior of the container can be accessed when the container is open. A slide fastener passes along the opening and continues past the opening along a strip which projects from the main body. Several lock engaging means are disposed along the strip along with several indicia, each indicia associated with one of the lock engaging means. The slide fastener may include a slider, and the dimensions of the lock engaging means and of the strip are such that when a suitable sized lock is secured to one of the lock engaging means, the slider is prevented from passing the lock.

According to another aspect, the invention provides a kit comprising a container and a lock. The container has a main body having an opening through which the interior of the container can be accessed when the container is open. A slide fastener passes along the opening and continues past the opening along a strip which projects from the main body. Several lock engaging means are disposed along the strip along with several indicia, each indicia associated with one of the lock engaging means. The slide fastener may include a slider, and the dimensions of the lock engaging means, of the lock, and of the strip are such that when the lock is secured to one of the lock engaging means, the slider is prevented from passing the lock.

The invention allows indicia on a container to be selectively identified using a secure locking mechanism. With a single operation, a particular indicia on the container can be indicated while at the same time securing the container.

BRIEF DESCRIPTION OF THE DRAWINGS

The features and advantages of the invention will become more apparent from the following detailed description of the preferred embodiment(s) with reference to the attached figures, wherein.

It is noted that in the attached figures, like features bear similar labels.

DETAILED DESCRIPTION

Figure 1:
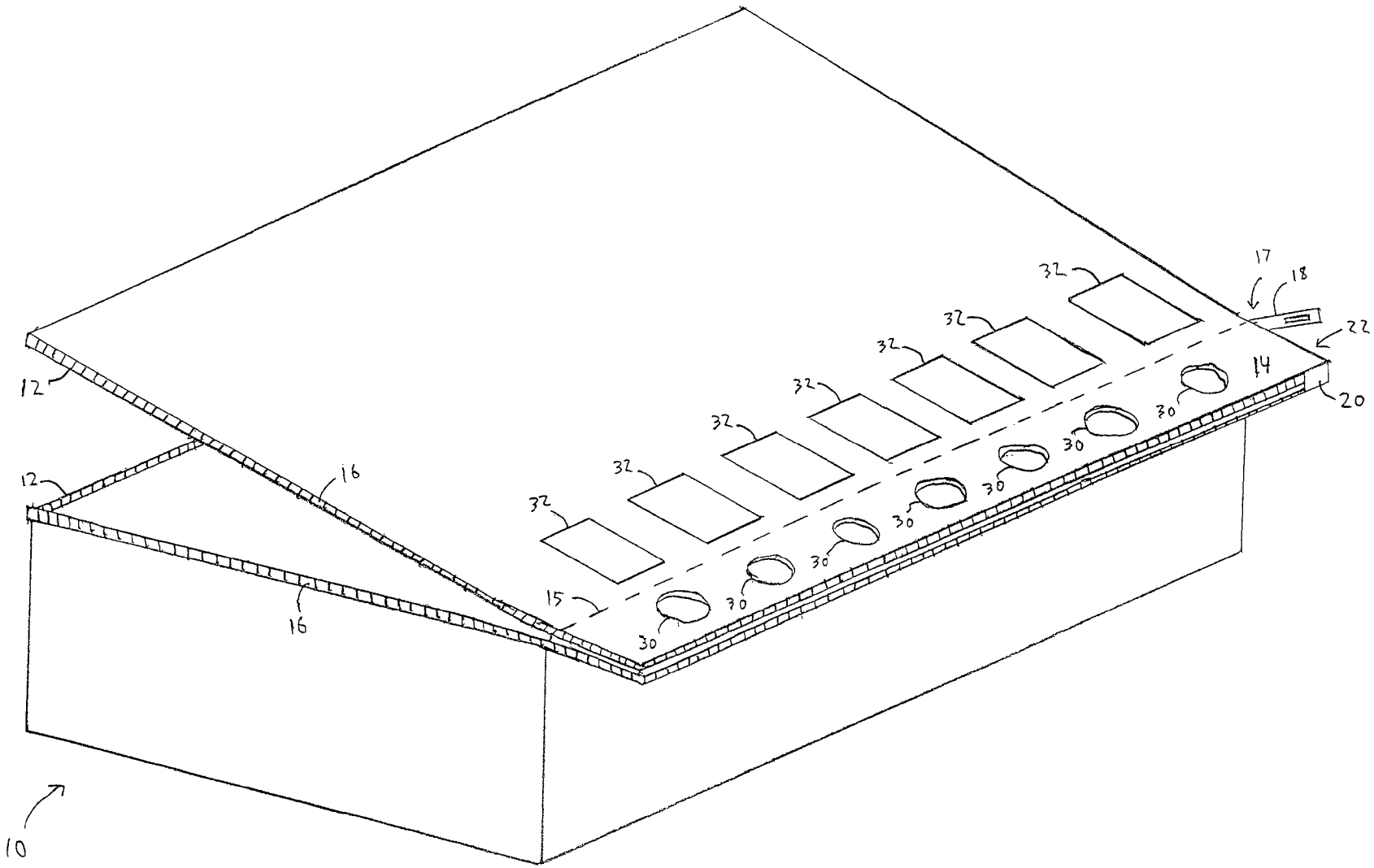
FIG. 1 is a plan view of a container having a lockable slide fastener and indicia according to one embodiment of the invention.

Referring to FIG. 1, a plan view of a container having a lockable slide fastener and indicia according to one embodiment of the invention is shown. The container includes a main body 10 having an opening 12 having two edges, through which the interior of the container can be accessed when the two edges of the opening are separated. The interior of the container may be a single compartment or may have multiple compartments. The container also includes a strip 14 which projects from the main body 10. At least a part of the strip 14 shown in FIG. 1 lies along a portion of the main body 10 which cannot be opened. The strip 14 may be rigid, semi-rigid, or flexible, and may be made of the same material as other parts of the container. The main body 10 itself may be of a rigid, semi-rigid, or flexible material, such as a rigid box or a soft-sided bag. The strip 14 projects from the main body 10 such that the strip 14 does not substantially interfere with the opening or closing of the container. In FIG. 1 this is illustrated by stitching 15 which attaches the lid of the container to one wall of the container in a position that leaves the strip 14 projecting from the lid, although other means may be used to hinge the lid to the sides of the container.

Figure 2:
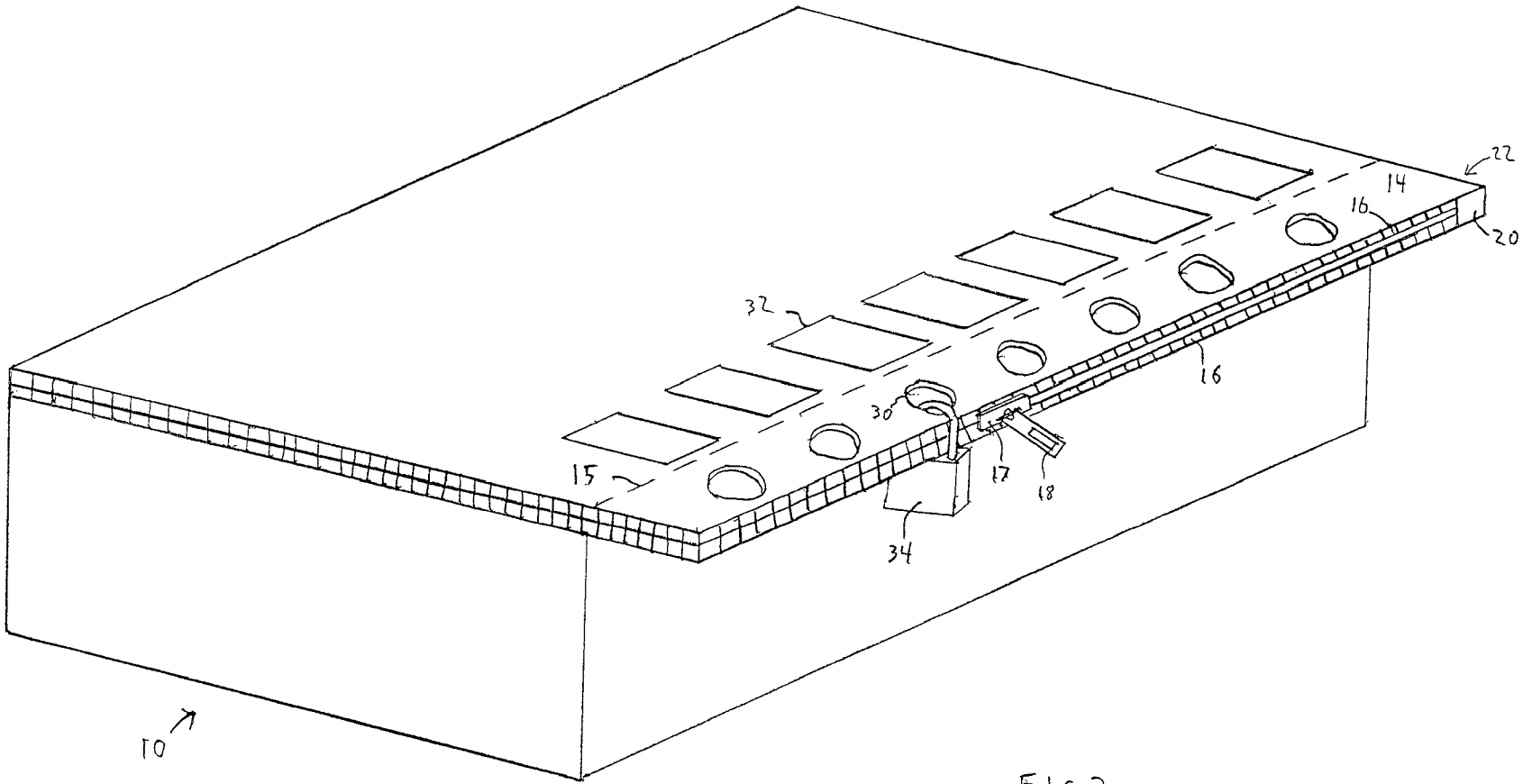
FIG. 2 is a plan view of the container of FIG. 1 when the container is securely closed.

The container includes a slide fastener 16, such as a zipper, having a slider 17 (hidden in FIG. 1 because of perspective, but shown in FIG. 2). The slider 17 may have a pull tab 18. The slide fastener 16 lies continuously along the edges of the container opening 12 and continues past the container opening 12 along the strip 14. Both tracks of the slide fastener 16 lie along the strip 14, but only one track of the slide fastener 16 lies along each edge of the container opening 12.

The slide fastener 16 has a first end 20 at one end lying on or near the strip. The slide fastener has a second end 22 (hidden in FIG. 1 because of perspective, but shown in the embodiment shown in FIG. 4) lying at the other end of the slide fastener 16. When the slider 17 is at or near the first end 20 the slide fastener 16 is substantially closed. When the slider is at or near the second end 22, the two tracks of the slide fastener 16 are substantially separated. By this arrangement, the container cannot be opened if the slider 17 is held along the strip 14. This is because even though the two tracks of the slide fastener 16 are partially separated, the separated length lies along the strip 14 while the unseparated length lies along the entire container opening 12. If the slider 17 is moved along the slide fastener 16 past the strip 14 so as to separate the two tracks of the slide fastener 16 for a length which lies along the opening 12, then the container is partially opened. If the slider 17 is moved to the second end 22 then the two tracks of the slide fastener 16, including the lengths that lie along the container opening 12, are fully separated and the container can be fully opened and the interior of the container easily accessed.

Numerous lock engaging means 30, such as apertures, are provided along the strip 14. Each lock engaging means 30 also has an associated indicia 32 located on the strip and/or an adjacent surface of the container, each of which is clearly associated with its respective lock engaging means 30. The slider 17, the lock engaging means 30, and the strip 14 are dimensioned such that when an appropriately sized lock is secured to one of the lock engaging means, the slider 17 cannot pass past the lock, as will be illustrated below with reference to FIG. 2.

Referring to FIG. 2, a plan view of the container of FIG. 1 is shown when the container is securely closed. The slider 17 has been moved to lie between the first end 20 and a lock 34 which has been secured to one of the lock engaging means 30. As discussed above, the lock 34 is dimensioned such that the slider 17 cannot pass the lock 34. Although the slider 17 may be moved along the strip 14 as far as the lock 34, thereby partially separating the tracks of the slide fastener 16, the container remains closed because the length of the slide fastener 16 lying along the container opening 12 remains closed. In operation, the container is securely fastened shut by closing the slide fastener 16 to a position between the first end 20 and the lock engaging means 30 to which the lock 34 will be secured, and then securing the lock 34. Once the lock 34 is fastened, the slider 17 cannot be passed past the lock 34 and so the container remains securely fastened. Only when the lock 34 is removed can the slider 17 be pulled beyond the strip 14 to a position along the container opening 12, at which point the interior of container may be accessed.

It should be noted that the term "securely-fastened" as used herein means closing the container is a tamper-evident way. The interior of the container cannot be accessed easily, such as by a child. Like all "secured" containers, the interior of the container may of course be accessed, even when locked, using more determined means such as by breaking the lock or cutting the walls of the container. Even in such a case, however, the lock and slide fastener arrangement advantageously provide evidence that the contents of the container have been tampered with.

The position of the lock 34 can be used to indicate a particular one of the indicia 32, namely the indicia associated with the particular lock engaging means 30 to which the lock 34 has been secured. The invention therefore allows the lock 34 to be used for two purposes. First, the lock 34 prevents the slide fastener 16 from being opened along the container opening 12 (hidden in FIG. 2) thereby securing the container, even though the slide fastener 16 may be opened partially along the strip 14. Second, the position of the lock 34 indicates unambiguously one of the indicia 32, namely the particular indicia 32 associated with the particular lock engaging means 30 into which the lock 34 is secured. The advantages of this combination of purposes will be shown by considering several example applications.

Figure 3:
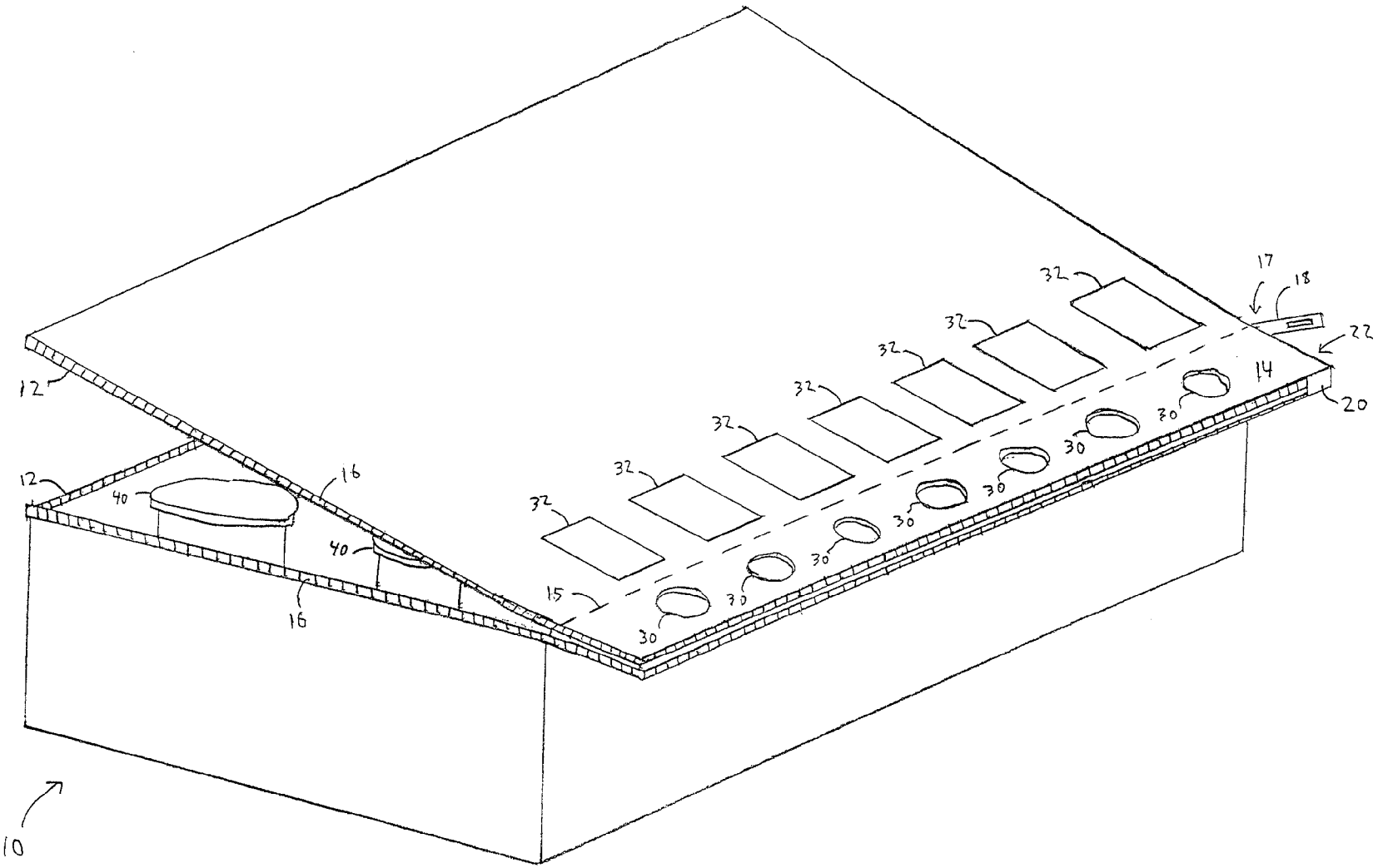
FIG. 3 is a plan view of an example application of the invention.

Medicine trays often have separate compartments for each dosage over a period of time. For example, a medicine tray may have seven compartments labeled Monday, Tuesday, etc., providing dosages for each day of a week. Such medicine trays are generally not secured however, and even if they are secured each compartment must still be loaded individually. Referring to FIG. 3 an example application of the invention is shown, in which the container is used for storing medicine. Unlike traditional medicine trays, the lock and slide fastener arrangement allow the container to be securely closed, preventing others from tampering with the contents. The medicine need not be separated into individual dosages placed in individual compartments. Instead, the medicine may simply be stored in its original container or containers 40, and the day of the week on which the next dosage is to be taken indicated by the position of the lock. FIG. 3 shows the container when opened, in order to show the medicine containers. When closed, the slider 17 is pulled along the slide fastener 16 so that it is positioned on the strip 14 between the lock engaging means 30 associated with the appropriate day of the week and the first end 20. The lock is then secured to the lock engaging means 30 associated with the appropriate day of the week. Of course other indicia may be used, such as combinations of days of the week and times of day, for example "Mon AM", "Mon PM", "Tue AM", etc.

Figure 4:
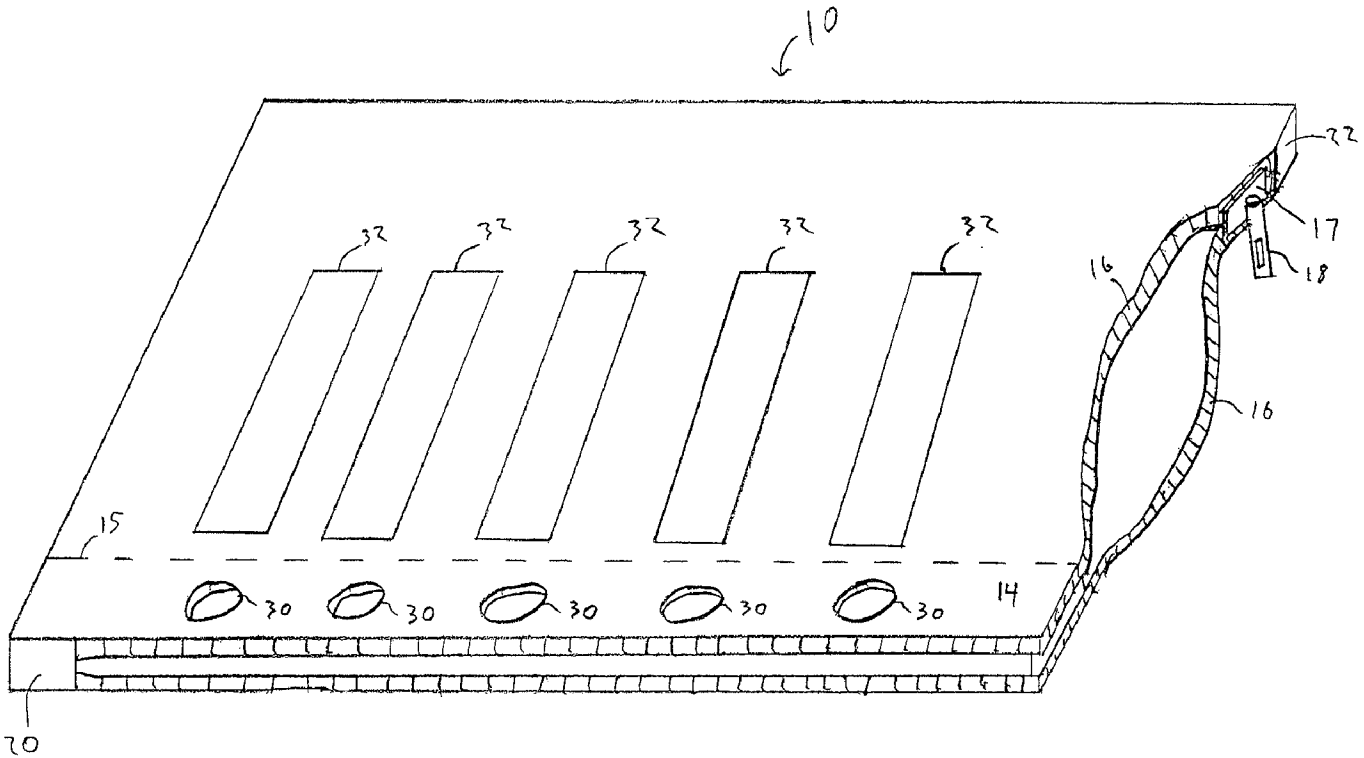
FIG. 4 is a plan view of another example application of the invention.

Another example application is shown in FIG. 4. The container is a routing envelope which is to contain sensitive documents. The slide fastener 16 passes along the container opening, which lies along one side of the envelope, and along the strip 14, which lies along a non-opening side of the envelope. The interior of the envelope is bounded on the strip side by stitching 15 or other fastening means so that the strip 14 does not interfere with the interior space of the envelope. Normally the destination of a routing envelope is marked on the outside of the envelope by pen. The present invention allows the destination of the routing envelope to be indicated simply by the position of the lock. The indicia associated with the lock engaging means indicate departments or people to which the routing envelope is to be sent next, although of course other types of destination may be used as indicia. FIG. 4 shows the envelope when opened, in order to show that the container opening is only along one side of the envelope as is typical of envelopes. Once documents are placed within the envelope, the slider 17 is pulled along the slide fastener 16 so that it is positioned on the strip 14 between the lock engaging means 30 associated with the appropriate routing destination and the first end 20. The lock is then secured to the lock engaging means 30 associated with the appropriate routing destination. Since the position of the lock indicates the destination of the envelope, there is no need to write the destination on the envelope.

The invention finds use in any container which is to be securely fastened shut by means of a slide fastener and which also has indicia indicating information about the contents of the container. Other applications include:

- usage reminder, in which each indicia indicates a day of the week, a time of day, or a combination of day of the week and time of day
- custody or responsibility of enclosure contents, in which each indicia indicates a person (e.g. Alice, Bob, Cathy, David)
- contents description, in which each indicia indicates a description of contents of the container (e.g. Breakfast, Lunch, Dinner)
- contents status, in which each indicia indicates a status (e.g. Good part, bad part, acceptable part)

time sensitivity of documents, in which each indicia indicates a time sensitivity (e.g. normal, urgent, asap)

time or date of packing or expiry, in which each indicia indicates a date, a time, or a combination of date and time origin or destination of contents, in which each indicia indicates a location or a department time container was last opened, in which each indicia indicates a day of the week, a date, a time of day, or any combination of day of the week, date, and time of day The lock 34 may be of any securely fastening type, such as a combination lock, a key operated lock, a one-time clip, or a reusable clip, and may be provided separately from the invention. The invention has been described with a lock distinct from the container. The lock 34 may alternatively be a part of the slider 17 or the pull tab 18. In such an embodiment, the lock engaging means may be discrete locations, such as provided by notches, at which the slider and lock combination must be located before the lock can be engaged. In this way, the lock and slider combination can still unambiguously indicate one of the indicia when locked. While this limits the choice of lock that can be used, there is less likelihood of the slider 17 being pulled past the lock or of the lock being misplaced.

Any type of indicia may be used, either permanent (such as dosage reminders with days of the week molded or printed onto the lid of the container) or replaceable (such as pockets into which labels are inserted, applicable for example with the names of people). In one embodiment in which replaceable labels are used as indicia, the pockets may be accessible only from the inside of the container but viewable from outside the container. In this way labels may only be placed or exchanged in the pockets by a person able to open the lock and hence open the container, which avoids an unauthorized person from tampering with the labels.

The invention has been described as the lock engaging means, slider, and strip being dimensioned such that when an appropriately sized lock is fastened to one of the lock engaging means the slider cannot pass past the lock. Alternatively, if the slider is equipped with a pull tab and the pull tab cannot easily be removed from the slider, then the lock engaging means, slider, strip, and pull tab may be dimensioned such that when an appropriately sized lock is fastened to one of the lock engaging means the slider and pull tab cannot pass past the lock.

Any type of slide fastener may be used, as long as it is capable of being held securely closed by restricting movement of the slider. For example, a zipper may be used.

Figure 5:
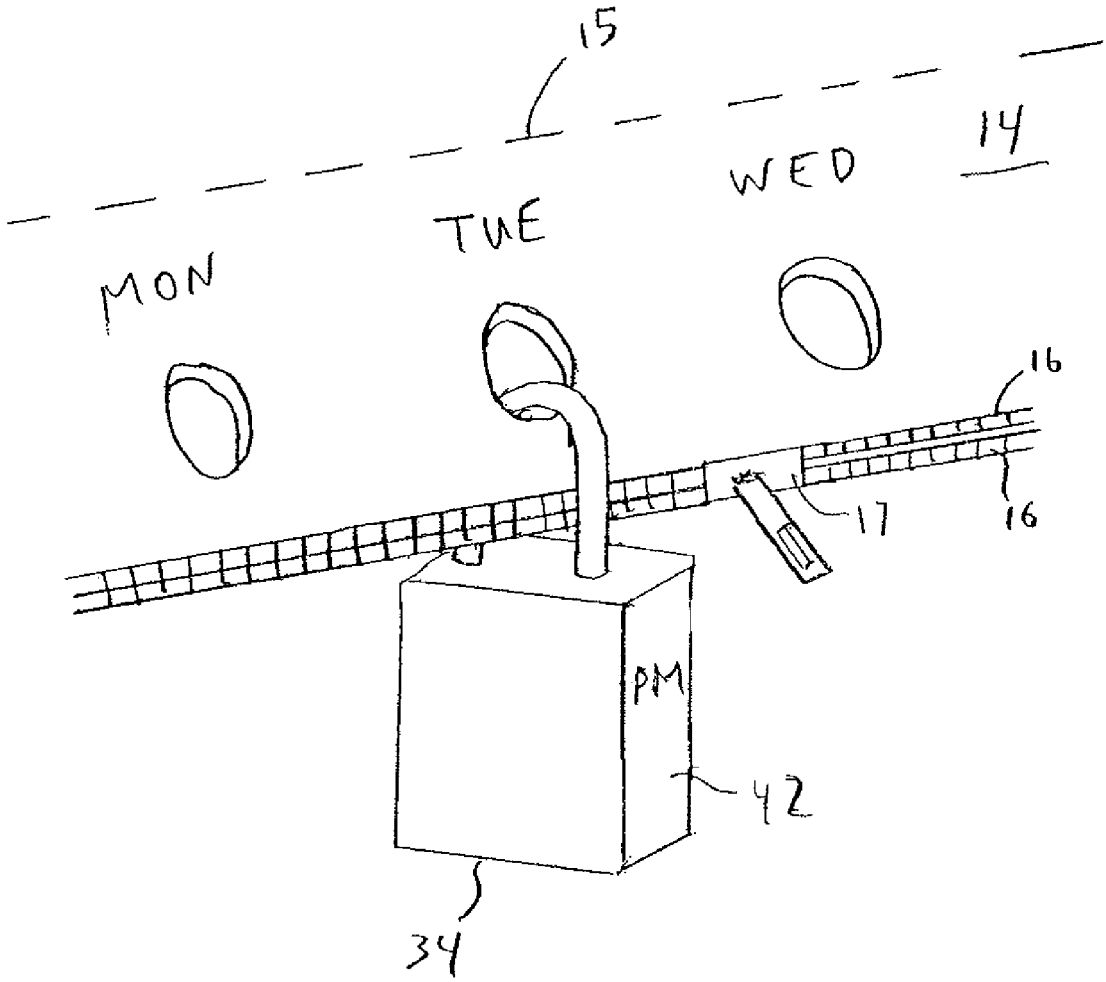
FIG. 5 is a plan view of a portion of the strip of FIG. 1 according to one embodiment of the invention.

The invention has been described as using only the position of the lock to indicate information about the container. Alternatively, the orientation of the lock may be used to provide additional information. In such an embodiment, the lock position indicates one of the indicia and the lock orientation indicates additional information. The lock orientation may be indicated by different markings or colour on edges of the lock. For example, referring to FIG. 5, one edge 42 of the lock may be marked "PM" and the opposite edge marked "AM". When used in combination with indicia indicating days of the week, the lock position and orientation can be used to indicate what day medicine is to be taken, and at what time of day.

Figure 6:
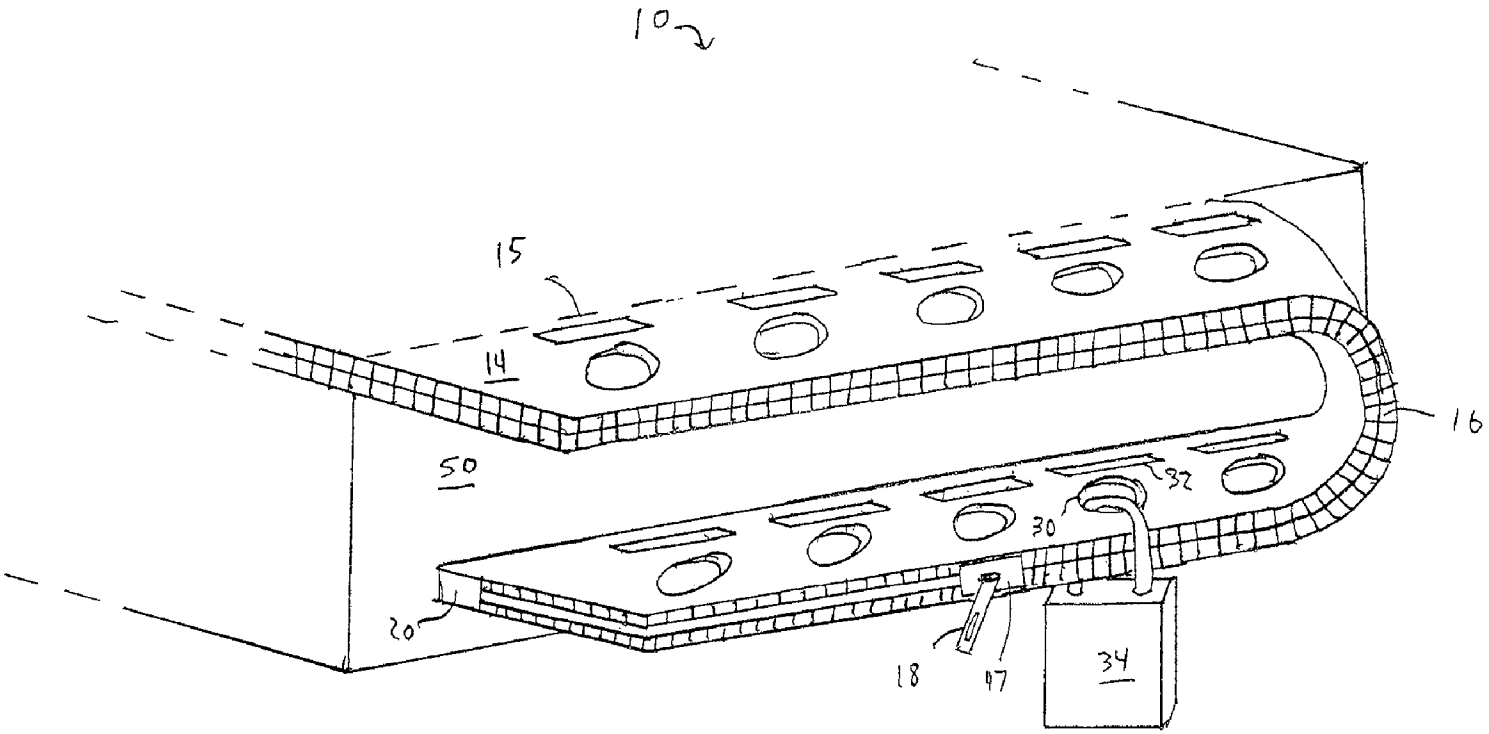
FIG. 6 is a plan view of a portion of a container having a lockable slide fastener and indicia according to another embodiment of the invention.

The embodiment of the invention illustrated in FIG. 1 has a strip 14 extending only along one edge of the container 10, and with the indicia 32 and lock engaging means 30 located along that one edge. More generally, the strip 14 along which the indicia and lock engaging means are located and along which the slide fastener 16 continues after sealing the container may be located anywhere on the container, or may even extend off the container as in the case of a slide fastener continuing along a strap or handle. The strip 14, and hence the path of the slide fastener 16, need not be limited to the non-opening side of a lidded box (as shown in FIG. 1) but may pass over the surface of the lid or a wall, or may travel along several non-opening edges of a container. Referring to FIG. 6, a portion of a container on which the strip 14 passes over a wall of the main body 10 is shown according to one embodiment of the invention. As can be seen, the strip 14, and hence the slide fastener 16, snakes over a surface 50 of the main body 10 including portions of the surface 50 away from the hinged edge of the lid. Lock engaging means 30 and associated indicia 32 are located all along the strip 14, thereby increasing the number of possible indicia.

Figure 7:
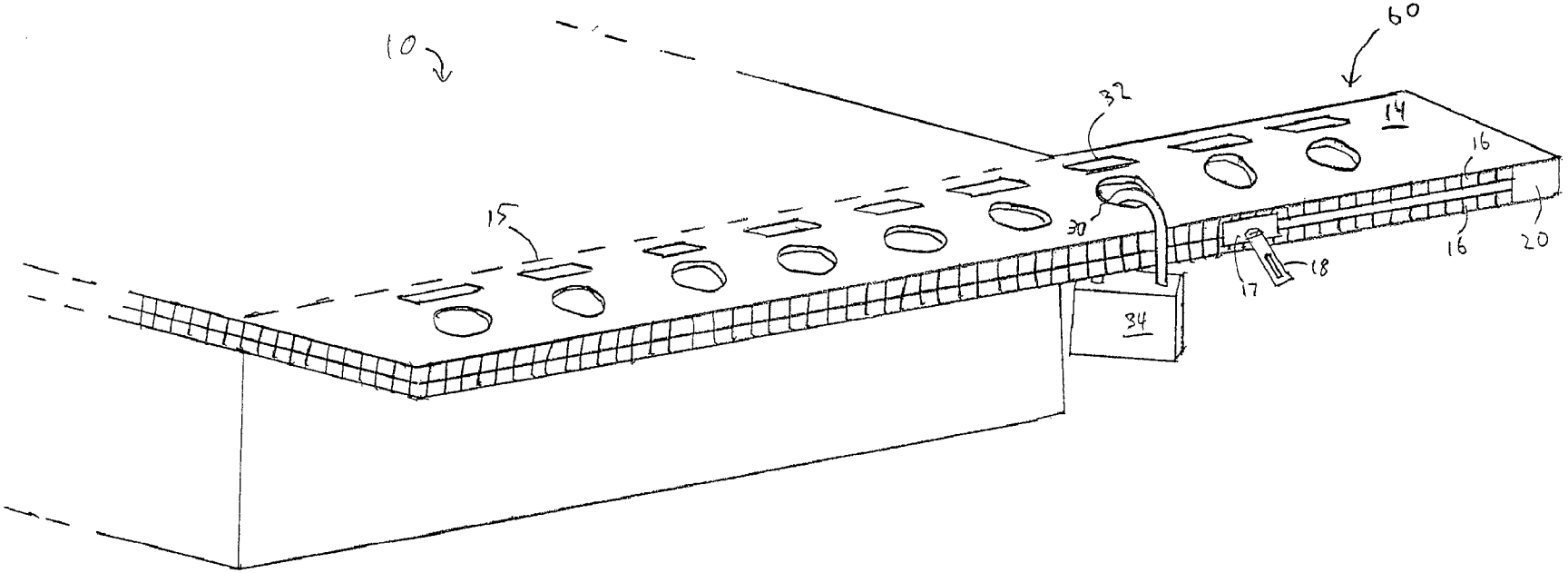
FIG. 7 is a plan view of a portion of a container having a lockable slide fastener and indicia according to another embodiment of the invention.

Referring to FIG. 7, a portion of a container on which the strip 14 extends off the main body 10 is shown according to one embodiment of the invention. The strip 14, and hence the slide faster 16, extends past the main body 10 onto an extension 60, which may be a carrying strap. Of course the embodiments shown in FIG. 1, FIG. 6 and FIG. 7 may be combined. For example, the strip 14 and the slide fastener 16 could lie along a surface of the main body and continue along a strap.

Figure 8:
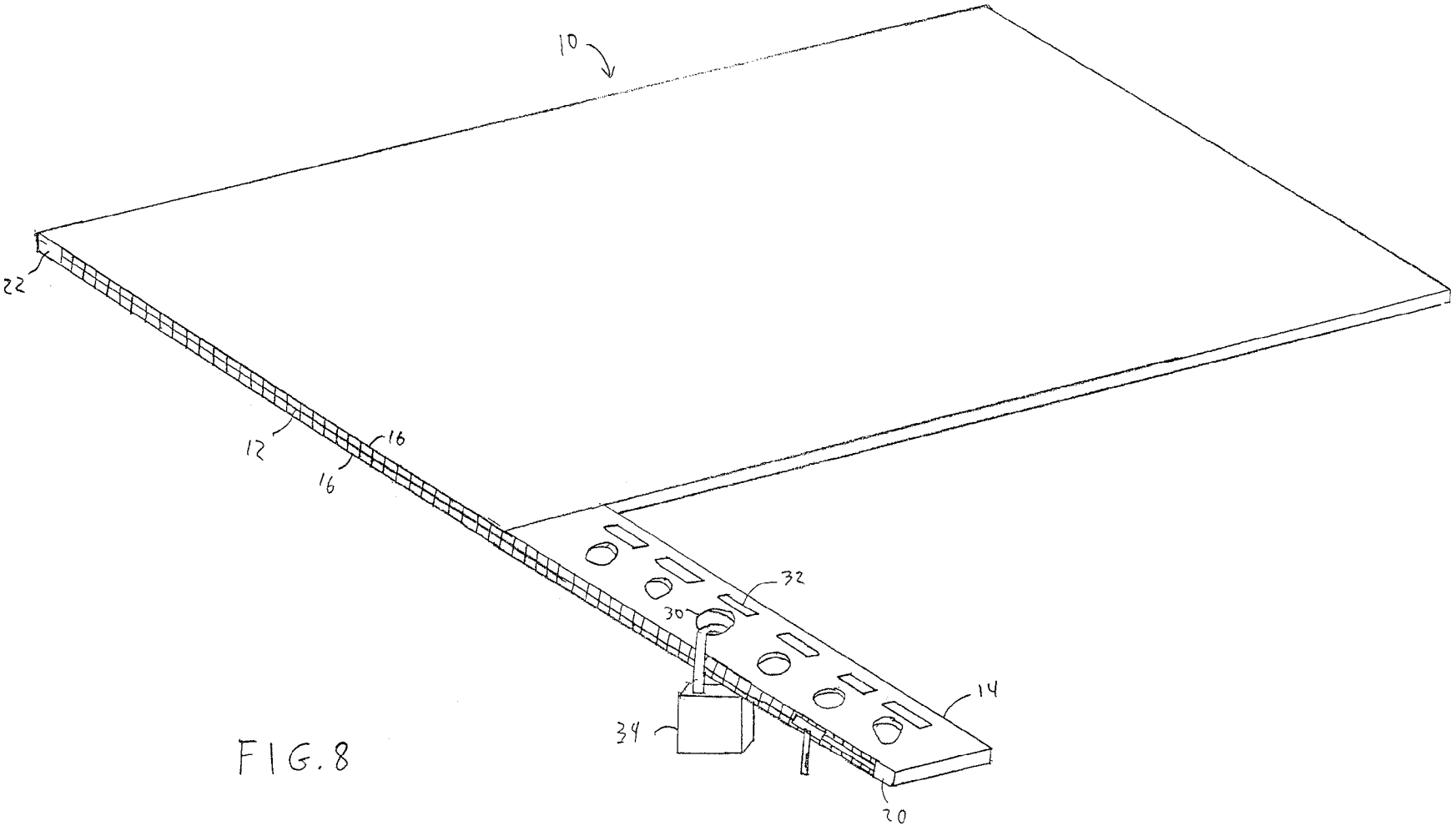
FIG. 8 is a plan view of a container having a lockable slide fastener and indicia according to another embodiment of the invention.

The invention has been described with the strip 14 projecting from the main body 10 along an edge of the main body 10 such that the strip lies along a non-opening segment of the container. Alternatively, the strip 14 may project from the main body 10 such that the strip does not lie along an edge of the main body. Referring to FIG. 8, a container on which the strip projects from the main body 10 is shown according to one embodiment of the invention. The strip 14 projects from the main body 10 but does not lie along an edge of the main body 10. The slide fastener 16 lies along the container opening 12 and continues along the strip 14. The lock engaging means 30 and the indicia 32 are located along the strip 14 but are not adjacent the main body 10 itself. The strip 14 may be used as a carrying strap. The strip 14 may even loop around and connect again to the main body 10 so as to form a looped carrying handle.

The embodiments shown in the figures are examples only. In general terms, a slide fastener used to seal a container lies along the container opening and continues past the container opening along a strip, the strip having numerous lock engaging means and indicia associated with each lock engaging means, the lock engaging means and the strip being dimensioned so that a lock secured to one of the lock engaging means prevents a slider of the slide fastener from passing the lock.

The embodiments presented are exemplary only and persons skilled in the art would appreciate that variations to the embodiments described above may be made without departing from the spirit of the invention. The scope of the invention is solely defined by the appended claims.

I claim:

1. A container comprising:

a main body;

an opening in the main body through which the interior of the container can be accessed when the container is open;

a slide fastener passing along the opening and continuing past the opening along a strip projecting from the main body;

a slider on the slide fastener;

a plurality of lock engaging means disposed along the strip; and a plurality of indicia, each indicia associated with one of the lock engaging means.

2. The container of claim 1 further comprising a pull tab fastened to the slider.

3. The container of claim 1 wherein the strip lies along a non-opening portion of the main body.

4. The container of claim 3 wherein the strip lies adjacent a hinged edge of the container to which a lid of the container is joined.

5. The container of claim 1 wherein the strip passes over a surface of the main body.

6. The container of claim 1 wherein the strip extends off the main body.

7. The container of claim 1 wherein the indicia are permanently affixed to the container.

8. The container of claim 1 wherein the indicia are labels within pockets affixed to the container.

9. The container of claim 8 wherein the labels can only be placed within the pockets when the container is open.

10. The container of claim 1 wherein the container can store medicine and wherein the plurality of indicia indicate when doses of medicine are to be taken.

11. The container of claim 1 wherein the container is a routing envelope, and wherein the plurality of indicia indicate destinations of the routing envelope.

12. The container of claim 1 further comprising a lock fastened to the slider or to a pull tab of the slide fastener.

13. The container of claim 1 wherein each indicia indicates a description of contents of the container, a department, a person, a status, a time sensitivity, a location, or any combination of a day of the week, a time of day, and a date.

14. A kit comprising the container of claim 1 and a lock.

15. The kit of claim 14 wherein the lock has differential marking on opposite edges.

16. The kit of claim 14 wherein the dimensions of the lock engaging means, the lock, and the strip are such that when the lock is secured to one of the lock engaging means, the slider cannot pass past the lock.

17. The kit of claim 16 wherein the indicia are labels within pockets affixed to the container, the pockets affixed to the container such that labels can only be placed within the pockets when the container is open.

* * * * *